US007963331B2

(12) United States Patent
Surjaatmadja et al.

(10) Patent No.: US 7,963,331 B2
(45) Date of Patent: Jun. 21, 2011

(54) METHOD AND APPARATUS FOR ISOLATING A JET FORMING APERTURE IN A WELL BORE SERVICING TOOL

(75) Inventors: Jim B. Surjaatmadja, Duncan, OK (US); Matthew Howell, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 0 days.

(21) Appl. No.: 12/691,135

(22) Filed: Jan. 21, 2010

(65) Prior Publication Data

US 2010/0126724 A1 May 27, 2010

Related U.S. Application Data

(62) Division of application No. 11/833,802, filed on Aug. 3, 2007, now Pat. No. 7,673,673.

(51) Int. Cl.
*E21B 33/13* (2006.01)
*E21B 43/26* (2006.01)
*E21B 43/114* (2006.01)

(52) U.S. Cl. ..... 166/285; 166/298; 166/300; 166/305.1; 166/308.1; 166/376

(58) Field of Classification Search ..... None
See application file for complete search history.

(56) References Cited

U.S. PATENT DOCUMENTS 2,201,290 A 5/1940 Greene
2,913,051 A 11/1959 Lister
3,057,405 A 10/1962 Mallinger
3,216,497 A 11/1965 Howard et al.
3,434,537 A 3/1969 Zandmer
4,105,069 A 8/1978 Baker
(Continued)

FOREIGN PATENT DOCUMENTS

GB 2415213 A 12/2005
(Continued)

OTHER PUBLICATIONS

Foreign communication from a related counterpart application—International Search Report and Written Opinion, PCT/GB2008/002646, Dec. 11, 2008, 9 pages.

(Continued)

*Primary Examiner* — George Suchfield
(74) *Attorney, Agent, or Firm* — John W. Wustenberg; Conley Rose, P.C.

(57) ABSTRACT

An embodiment of a well bore servicing apparatus includes a housing having a through bore and at least one high pressure fluid aperture in the housing, the fluid aperture being in fluid communication with the through bore to provide a high pressure fluid stream to the well bore, and a removable member coupled to the housing and disposed adjacent the fluid jet forming aperture and isolating the fluid jet forming aperture from an exterior of the housing. An embodiment of a method of servicing a well bore includes applying a removable member to an exterior of a well bore servicing tool, wherein the removable member covers at least one high pressure fluid aperture disposed in the tool, lowering the tool into a well bore, exposing the tool to a well bore material, wherein the removable cover prevents the well bore material from entering the fluid aperture, removing the removable member to expose a fluid flow path adjacent an outlet of the high pressure fluid aperture, and flowing a well bore servicing fluid through the fluid aperture outlet and flow path.

21 Claims, 10 Drawing Sheets

U.S. PATENT DOCUMENTS

| | | | |
|---|---|---|---|
| 4,673,039 | A | 6/1987 | Mohaupt |
| 5,125,582 | A | 6/1992 | Surjaatmadja et al. |
| 5,325,917 | A | 7/1994 | Szarka |
| 5,325,923 | A | 7/1994 | Surjaatmadja et al. |
| 5,361,856 | A | 11/1994 | Surjaatmadja et al. |
| 5,366,015 | A | 11/1994 | Surjaatmadja et al. |
| 5,381,862 | A | 1/1995 | Szarka et al. |
| 5,396,957 | A | 3/1995 | Surjaatmadja et al. |
| 5,425,424 | A | 6/1995 | Reinhardt et al. |
| 5,484,016 | A | 1/1996 | Surjaatmadja et al. |
| 5,494,103 | A | 2/1996 | Surjaatmadja et al. |
| 5,499,678 | A | 3/1996 | Surjaatmadja et al. |
| 5,533,571 | A | 7/1996 | Surjaatmadja et al. |
| 5,765,642 | A | 6/1998 | Surjaatmadja |
| 5,944,105 | A | 8/1999 | Nguyen |
| 6,006,838 | A | 12/1999 | Whiteley et al. |
| 6,189,618 | B1 | 2/2001 | Beeman et al. |
| 6,286,599 | B1 | 9/2001 | Surjaatmadja et al. |
| 6,336,502 | B1 | 1/2002 | Surjaatmadja et al. |
| 6,662,874 | B2 | 12/2003 | Surjaatmadja et al. |
| 6,719,054 | B2 | 4/2004 | Cheng et al. |
| 6,725,933 | B2 | 4/2004 | Middaugh et al. |
| 6,779,607 | B2 | 8/2004 | Middaugh et al. |
| 6,938,690 | B2 | 9/2005 | Surjaatmadja |
| 7,066,265 | B2 | 6/2006 | Surjaatmadja |
| 7,090,153 | B2 | 8/2006 | King et al. |
| 7,159,660 | B2 | 1/2007 | Justus |
| 7,195,067 | B2 | 3/2007 | Manke et al. |
| 7,225,869 | B2 | 6/2007 | Willett et al. |
| 7,228,908 | B2 | 6/2007 | East, Jr. et al. |
| 7,234,529 | B2 | 6/2007 | Surjaatmadja |
| 7,237,612 | B2 | 7/2007 | Surjaatmadja et al. |
| 7,243,723 | B2 | 7/2007 | Surjaatmadja et al. |
| 7,273,099 | B2 | 9/2007 | East, Jr. et al. |
| 7,287,592 | B2 | 10/2007 | Surjaatmadja et al. |
| 7,296,625 | B2 | 11/2007 | East, Jr. |
| 7,337,844 | B2 | 3/2008 | Surjaatmadja et al. |
| 7,343,975 | B2 | 3/2008 | Surjaatmadja et al. |
| 7,353,879 | B2 | 4/2008 | Todd et al. |
| 7,377,322 | B2 | 5/2008 | Hofman |
| 7,398,825 | B2 | 7/2008 | Nguyen et al. |
| 7,422,060 | B2 | 9/2008 | Hammami et al. |
| 7,431,090 | B2 | 10/2008 | Surjaatmadja et al. |
| 7,506,689 | B2 | 3/2009 | Surjaatmadja et al. |
| 7,520,327 | B2 | 4/2009 | Surjaatmadja |
| 7,527,103 | B2 | 5/2009 | Huang et al. |
| 7,571,766 | B2 | 8/2009 | Pauls et al. |
| 7,575,062 | B2 | 8/2009 | East, Jr. |
| 7,617,871 | B2 | 11/2009 | Surjaatmadja et al. |
| 7,673,673 | B2 * | 3/2010 | Surjaatmadja et al. ..... 166/55 |
| 7,681,645 | B2 | 3/2010 | McMillin et al. |
| 2006/0086507 | A1 | 4/2006 | Surjaatmadja et al. |
| 2006/0207765 | A1 * | 9/2006 | Hofman ..... 166/313 |
| 2007/0017675 | A1 * | 1/2007 | Hammami et al. ..... 166/278 |
| 2007/0102156 | A1 | 5/2007 | Nguyen et al. |
| 2007/0261851 | A1 | 11/2007 | Surjaatmadja |
| 2007/0284114 | A1 | 12/2007 | Swor et al. |
| 2008/0000637 | A1 | 1/2008 | McDaniel et al. |
| 2008/0060810 | A9 | 3/2008 | Nguyen et al. |
| 2008/0083531 | A1 | 4/2008 | Surjaatmadja |
| 2008/0135248 | A1 | 6/2008 | Talley et al. |
| 2008/0202764 | A1 | 8/2008 | Clayton et al. |
| 2008/0217021 | A1 | 9/2008 | Lembcke et al. |
| 2008/0264641 | A1 | 10/2008 | Slabaugh et al. |
| 2008/0296024 | A1 * | 12/2008 | Huang et al. ..... 166/311 |

FOREIGN PATENT DOCUMENTS

| | | | |
|---|---|---|---|
| WO | 2008093047 | A1 | 8/2008 |

OTHER PUBLICATIONS

Foreign communication from a related counterpart application—International Search Report and Written Opinion, PCT/GB2009/002693, Mar. 2, 2010, 10 pages.

Office Action dated Sep. 18, 2009 (6 pages), U.S. Appl. No. 12/274,193, filed Nov. 19, 2008.

Patent application entitled "Apparatus and method for servicing a wellbore," by Jim B. Surjaatmadja, et al., filed Nov. 19, 2008 as U.S. Appl. No. 12/274,193.

Patent application entitled "Method of treating a plurality of zones," filed Dec. 15, 2006 as U.S. Appl. No. 11/639,914.

Notice of Allowance dated Jun. 22, 2010 (13 pages), U.S. Appl. No. 12/274,193, filed Nov. 19, 2008.

Supplemental Notice of Allowability dated Jul. 15, 2010 (13 pages), U.S. Appl. No. 12/274,193, filed Nov. 19, 2008.

* cited by examiner

METHOD AND APPARATUS FOR ISOLATING A JET FORMING APERTURE IN A WELL BORE SERVICING TOOL

CROSS-REFERENCE TO RELATED APPLICATIONS

This is a Divisional Application of U.S. patent application Ser. No. 11/833,802, filed Aug. 3, 2007 and published as US 2009/032255 A1, and entitled "Method and Apparatus for Isolating a Jet Forming Aperture in a Well Bore Servicing Tool," which is hereby incorporated by reference herein in its entirety.

BACKGROUND

Hydrocarbon-producing wells often are stimulated by hydraulic fracturing operations, wherein a fracturing fluid may be introduced into a portion of a subterranean formation penetrated by a well bore at a hydraulic pressure sufficient to create or enhance at least one fracture therein. Stimulating or treating the well in such ways increases hydrocarbon production from the well.

In some wells, it may be desirable to individually and selectively create multiple fractures along a well bore at a distance apart from each other. The multiple fractures should have adequate conductivity, so that the greatest possible quantity of hydrocarbons in an oil and gas reservoir can be drained/produced into the well bore. When stimulating a reservoir from a well bore, especially those well bores that are highly deviated or horizontal, it may be difficult to control the creation of multi-zone fractures along the well bore without cementing a casing or liner to the well bore and mechanically isolating the subterranean formation being fractured from previously-fractured formations, or formations that have not yet been fractured.

To avoid explosive perforating steps and other undesirable actions associated with fracturing, certain tools may be placed in the well bore to place fracturing fluids under high pressure and direct the fluids into the formation. In some tools, high pressure fluids may be "jetted" into the formation. For example, a tool having jet forming nozzles, also called a "hydrojetting" or "hydrajetting" tool, may be placed in the well bore near the formation. Hydrojetting may also be referred to as a process of controlling high pressure fluid jets with surgical accuracy. The jet forming nozzles create a high pressure fluid flow path directed at the formation of interest. In another tool, which may be called a casing window, a stimulation sleeve, or a stimulation valve, a section of casing includes holes or apertures pre-formed in the casing. The casing window may also include an actuatable window assembly for selectively exposing the casing holes to a high pressure fluid inside the casing. The casing holes may include jet forming nozzles to provide a fluid jet into the formation, causing tunnels and fractures therein.

SUMMARY OF THE INVENTION

An embodiment of a well bore servicing apparatus includes a housing having a through bore and at least one high pressure fluid aperture in the housing, the fluid aperture being in fluid communication with the through bore to provide a high pressure fluid stream to the well bore, and a removable member coupled to the housing and disposed adjacent the fluid jet forming aperture and isolating the fluid jet forming aperture from an exterior of the housing. In other embodiments, the removable member is a degradable sleeve removed by degradation. Still other embodiments include a jet forming nozzle in the high pressure fluid aperture.

An embodiment of a method of servicing a well bore includes applying a removable member to an exterior of a well bore servicing tool, wherein the removable member covers at least one high pressure fluid aperture disposed in the tool, lowering the tool into a well bore, exposing the tool to a well bore material, wherein the removable cover prevents the well bore material from entering the fluid aperture, removing the removable member to expose a fluid flow path adjacent an outlet of the high pressure fluid aperture, and flowing a well bore servicing fluid through the fluid aperture outlet and flow path. In other embodiments, removing the removable member includes degrading a protective sleeve. In yet other embodiments, flowing the well bore servicing fluid further expands the fluid flow path adjacent the tool, into the surrounding formation, or both.

Another embodiment of a method of servicing a well bore includes disposing a fluid jetting tool in the well bore, the fluid jetting tool having a fluid jetting aperture and a removable member adjacent the fluid jetting aperture, cementing the fluid jetting tool into the well bore, wherein the removable member prevents cement from entering the fluid jetting aperture, and removing the removable member to expose a fluid flow path adjacent an outlet of the fluid jetting aperture. Other embodiments include pumping a well bore servicing fluid into the fluid jetting tool and through the fluid jetting aperture, and perforating the cement to further expand the fluid flow path. Still other embodiments include continuing to pump the servicing fluid into a formation adjacent the perforated cement to fracture the formation.

BRIEF DESCRIPTION OF THE DRAWINGS

For a more detailed description of the embodiments, reference will now be made to the following accompanying drawings.

DETAILED DESCRIPTION

Figure 1:
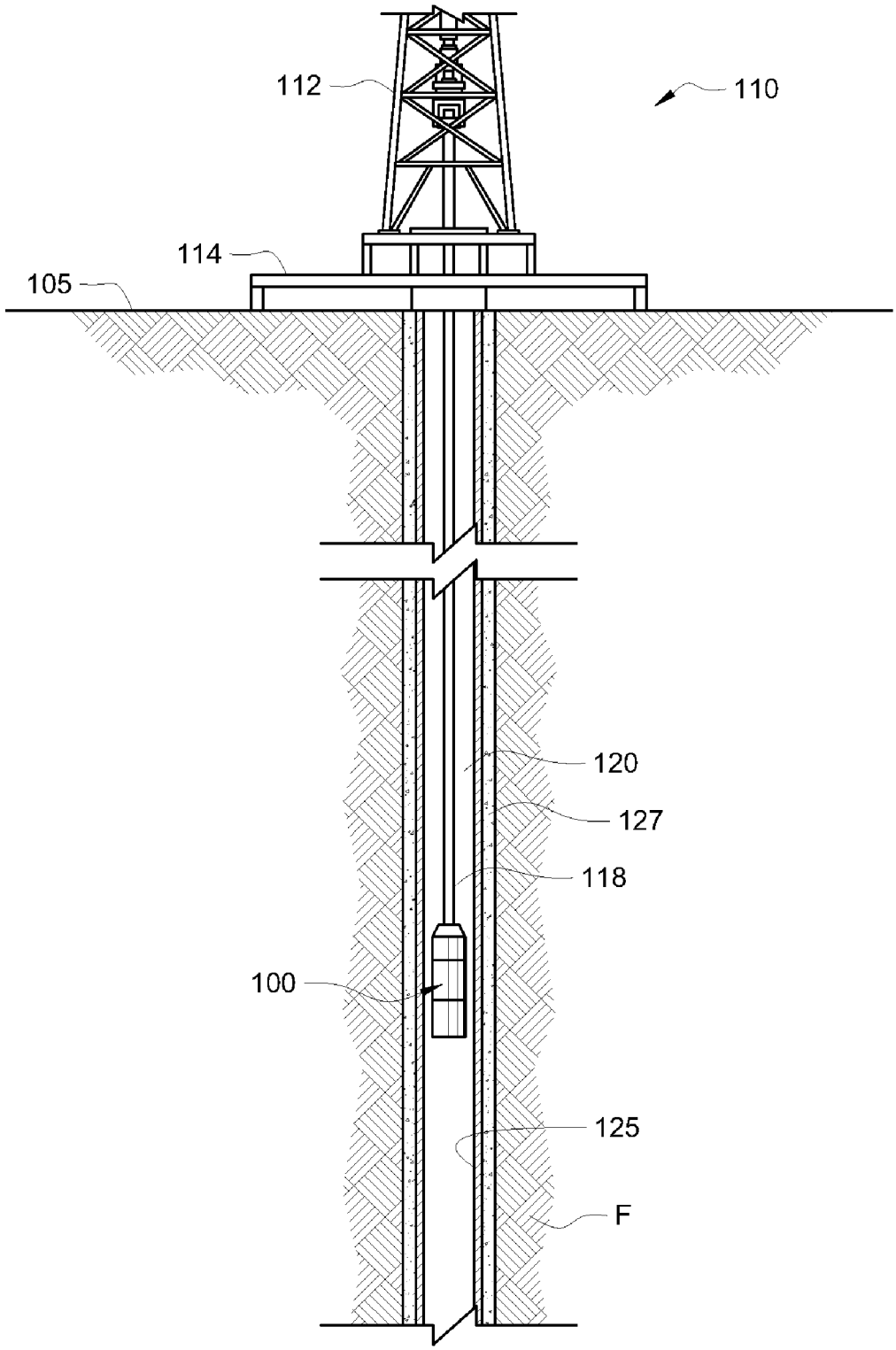
FIG. 1 is a schematic, partial cross-section view of a fluid stimulation tool in an operating environment.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. The various characteristics mentioned above, as well as other features and characteristics described in more detail below, will be readily apparent to those skilled in the art upon reading the following detailed description of the embodiments, and by referring to the accompanying drawings.

Disclosed herein are several embodiments of fracturing or stimulation tools wherein pressurized fluid is directed or jetted through fluid apertures into an earth formation to create and extend fractures in the earth formation, or otherwise extend a flow path from the tool to the formation. Also disclosed are several embodiments of a removable member disposed over the fluid apertures, particularly jet forming nozzles, for example, to isolate the fluid apertures from an exterior environment of the tool. The exterior environment of the tool may include cement or other viscous, aperture-plugging materials that negatively effect the pressurizing or jetting nature of the apertures. As disclosed herein, exemplary embodiments of the removable member include a degradable sleeve wrapped around a portion of the tool housing having the fluid apertures. A degradable sleeve can comprise a variety of materials, as disclosed below. Also disclosed herein are operations of a fluid pressurizing or jetting tool including the removable member disposed over the fluid apertures to isolate such apertures from materials that may encumber or obstruct the fluid apertures. As disclosed, the operations of the fluid pressurizing or jetting tools may include a complete well servicing or treatment process to adequately fracture the earth formation.

FIG. 1 schematically depicts an exemplary operating environment for a fluid pressurizing or hydrojetting tool 100 for fracturing an earth formation F. As disclosed below, there are many embodiments of the fluid pressurizing or hydrojetting tool 100, but for reference purposes, the schematic tool 100 will be called the "fluid stimulation tool 100." As depicted, a drilling rig 110 is positioned on the earth's surface 105 and extends over and around a well bore 120 that penetrates a subterranean formation F for the purpose of recovering hydrocarbons. The well bore 120 may drilled into the subterranean formation F using conventional (or future) drilling techniques and may extend substantially vertically away from the surface 105 or may deviate at any angle from the surface 105. In some instances, all or portions of the well bore 120 may be vertical, deviated, horizontal, and/or curved.

At least the upper portion of the well bore 120 may be lined with casing 125 that is cemented 127 into position against the formation F in a conventional manner. Alternatively, the operating environment for the fluid stimulation tool 100 includes an uncased well bore 120. The drilling rig 110 includes a derrick 112 with a rig floor 114 through which a work string 118, such as a cable, wireline, E-line, Z-line, jointed pipe, coiled tubing, or casing or liner string (should the well bore 120 be uncased), for example, extends downwardly from the drilling rig 110 into the well bore 120. The work string 118 suspends a representative downhole fluid stimulation tool 100 to a predetermined depth within the well bore 120 to perform a specific operation, such as perforating the casing 125, expanding a fluid path therethrough, or fracturing the formation F. The drilling rig 110 is conventional and therefore includes a motor driven winch and other associated equipment for extending the work string 118 into the well bore 120 to position the fluid stimulation tool 100 at the desired depth.

While the exemplary operating environment depicted in FIG. 1 refers to a stationary drilling rig 110 for lowering and setting the fluid stimulation tool 100 within a land-based well bore 120, one of ordinary skill in the art will readily appreciate that mobile workover rigs, well servicing units, such as slick lines and e-lines, and the like, could also be used to lower the tool 100 into the well bore 120. It should be understood that the fluid stimulation tool 100 may also be used in other operational environments, such as within an offshore well bore or a deviated or horizontal well bore.

Figure 2:
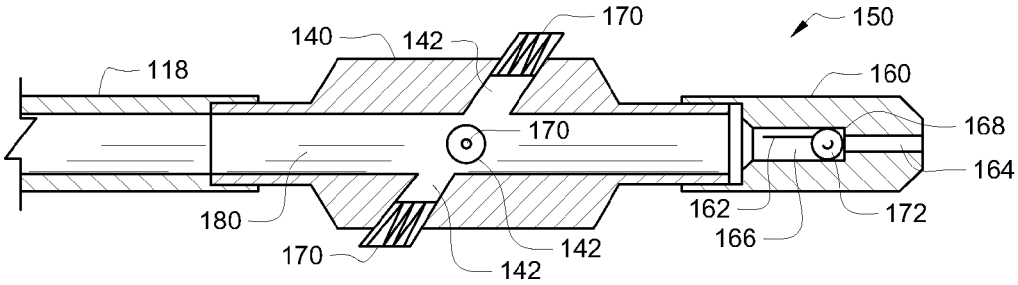
FIG. 2 is a cross-section view of a hydrojetting tool assembly.

The fluid stimulation tool 100 may take a variety of different forms. In an embodiment, the tool 100 comprises a hydrojetting tool assembly 150, which in certain embodiments may comprise a tubular hydrojetting tool 140 and a tubular, ball-activated, flow control device 160, as shown in FIG. 2. The tubular hydrojetting tool 140 generally includes an axial fluid flow passageway 180 extending therethrough and communicating with at least one angularly spaced lateral port 142 disposed through the sides of the tubular hydrojetting tubular hydrojetting tool 140. In certain embodiments, the axial fluid flow passageway 180 communicates with as many angularly spaced lateral ports 142 as may be feasible, (e.g., a plurality of ports). A fluid jet forming nozzle 170 generally is connected within each of the lateral ports 142. As used herein, the term "fluid jet forming nozzle" refers to any fixture that may be coupled to an aperture so as to allow the communication of a fluid therethrough such that the fluid velocity exiting the jet is higher than the fluid velocity at the entrance of the jet. In certain embodiments, the fluid jet forming nozzles 170 may be disposed in a single plane that may be positioned at a predetermined orientation with respect to the longitudinal axis of the tubular hydrojetting tool 140. Such orientation of the plane of the fluid jet forming nozzles 170 may coincide with the orientation of the plane of maximum principal stress in the formation to be fractured relative to the longitudinal axis of the well bore penetrating the formation.

The tubular, ball-activated, flow control device 160 generally includes a longitudinal flow passageway 162 extending therethrough, and may be threadedly connected to the end of the tubular hydrojetting tool 140 opposite from the work string 118. The longitudinal flow passageway 162 may comprise a relatively small diameter longitudinal bore 164 through an exterior end portion of the tubular, ball-activated, flow control device 160 and a larger diameter counter bore 166 through the forward portion of the tubular, ball-activated, flow control device 160, which may form an annular seating surface 168 in the tubular, ball-activated, flow control device 160 for receiving a ball 172. Before ball 172 is seated on the annular seating surface 168 in the tubular, ball-activated, flow control device 160, fluid may freely flow through the tubular hydrojetting tool 140 and the tubular, ball-activated, flow control device 160. After ball 172 is seated on the annular seating surface 168 in the tubular, ball-activated, flow control device 160 as illustrated in FIG. 2, flow through the tubular, ball-activated, flow control device 160 may be terminated, which may cause fluid pumped into the work string 118 and into the tubular hydrojetting tool 140 to exit the tubular hydrojetting tool 140 by way of the fluid jet forming nozzles 170 thereof. When an operator desires to reverse-circulate fluids through the tubular, ball-activated, flow control device 160, the tubular hydrojetting tool 140 and the work string 118, the fluid pressure exerted within the work string 118 may be reduced, whereby higher pressure fluid surrounding the tubular hydrojetting tool 140 and tubular, ball-activated, flow control device 160 may flow freely through the tubular, ball-activated, flow control device 160, causing the ball 172 to disengage from annular seating surface 168, and through the fluid jet forming nozzles 170 into and through the work string 118.

The hydrojetting tool assembly 150, schematically represented at 100 in FIG. 1, may be moved to different locations in the well bore 120 by using work string 118. Work string 118 also carries the fluid to be jetted through jet forming nozzles 170. During use, the hydrojetting tool assembly 150 may be exposed to a variety of hindrances or nozzle plugging materials. Therefore, it is desirable to maintain unhindered jet forming nozzles 170 such that successful fluid jets are created each time the tool assembly 150 is used.

Figure 3:
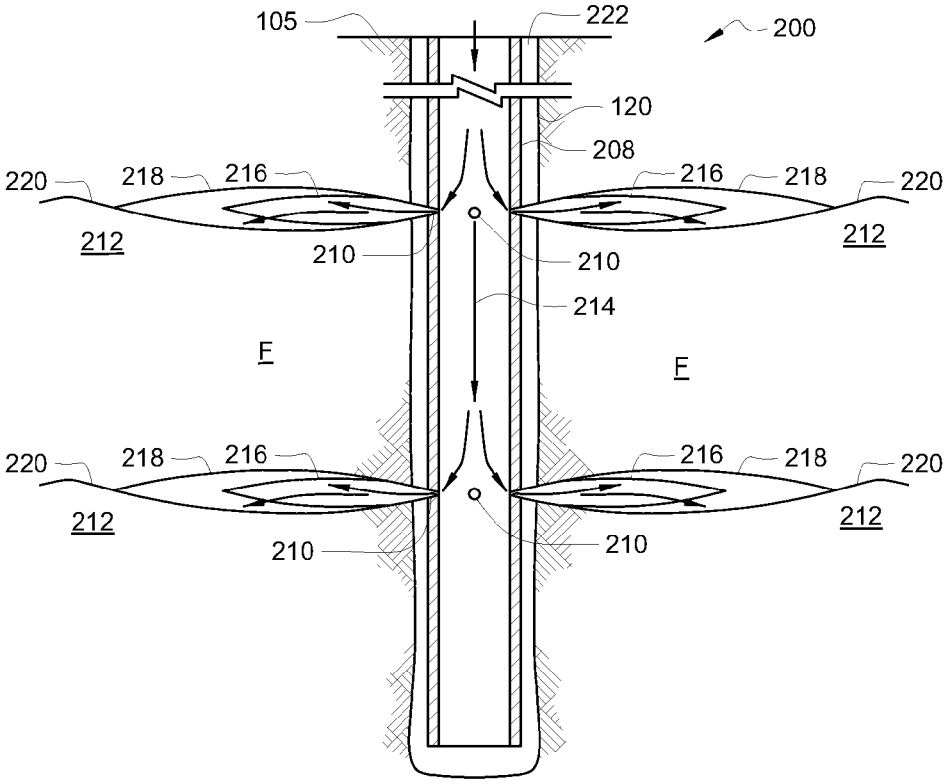
FIG. 3 is a cross-section view of a fluid pressurizing well completion assembly.

Referring now to FIG. 3, in another embodiment, the schematic fluid jetting tool 100 comprises an exemplary well completion assembly 200. The well completion assembly 200 is disposed in the well bore 120 coupled to the surface 105 and extending down through the subterranean formation F. The completion assembly 200 includes a conduit 208 extending through at least a portion of the well bore 120. The conduit 208 may or may not be cemented to the subterranean formation F. In some embodiments, the conduit 208 is a portion of a casing string coupled to the surface 105 by an upper casing string, represented schematically by work string 118 in FIG. 1. Cement is flowed through an annulus 222 to attach the casing string to the well bore 120. In some embodiments, the conduit 208 may be a liner that is coupled to a previous casing string. When uncemented, the conduit 208 may contain one or more permeable liners, or it may be a solid liner. As used herein, the term "permeable liner" includes, but is not limited to, screens, slots and preperforations. Those of ordinary skill in the art, with the benefit of this disclosure, will recognize whether the conduit 208 should be cemented or uncemented and whether conduit 208 should contain one or more permeable liners.

The conduit 208 includes one or more pressurized fluid apertures 210. Fluid apertures 210 may be any size, for example, 0.75 inches in diameter. In some embodiments, the fluid apertures 210 are jet forming nozzles, wherein the diameter of the jet forming nozzles are reduced, for example, to 0.25 inches. The inclusion of jet forming nozzles 210 in the well completion assembly 200 adapts the assembly 200 for use in hydrojetting. In some embodiments, the fluid jet forming nozzles 210 may be longitudinally spaced along the conduit 208 such that when the conduit 208 is inserted into the well bore 120, the fluid jet forming nozzles 210 will be adjacent to a local area of interest, e.g., zones 212 in the subterranean formation F. As used herein, the term "zone" simply refers to a portion of the formation and does not imply a particular geological strata or composition. Conduit 208 may have any number of fluid jet forming nozzles, configured in a variety of combinations along and around the conduit 208.

Once the well bore 120 has been drilled and, if deemed necessary, cased, a fluid 214 may be pumped into the conduit 208 and through the fluid jet forming nozzles 210 to form fluid jets 216. In one embodiment, the fluid 214 is pumped through the fluid jet forming nozzles 210 at a velocity sufficient for the fluid jets 216 to form perforation tunnels 218. In one embodiment, after the perforation tunnels 218 are formed, the fluid 214 is pumped into the conduit 208 and through the fluid jet forming nozzles 210 at a pressure sufficient to form cracks or fractures 220 along the perforation tunnels 218.

The composition of fluid 214 may be changed to enhance properties desirous for a given function, i.e., the composition of fluid 214 used during fracturing may be different than that used during perforating. In certain embodiments, an acidizing fluid may be injected into the formation F through the conduit 208 after the perforation tunnels 218 have been created, and shortly before (or during) the initiation of the cracks or fractures 220. The acidizing fluid may etch the formation F along the cracks or fractures 220, thereby widening them. In certain embodiments, the acidizing fluid may dissolve fines, which further may facilitate flow into the cracks or fractures 220. In another embodiment, a proppant may be included in the fluid 214 being flowed into the cracks or fractures 220, which proppant may prevent subsequent closure of the cracks or fractures 220. The proppant may be fine or coarse. In yet another embodiment, the fluid 214 includes other erosive substances, such as sand, to form a slurry. Complete well treatment processes including a variety of fluids and fluid particulates may be understood with reference to Halliburton Energy Service's SURGIFRAC® and COBRAMAX®. The fluid component embodiments described above may be used in various combinations with each other and with the other embodiments disclosed herein.

Figure 4A:
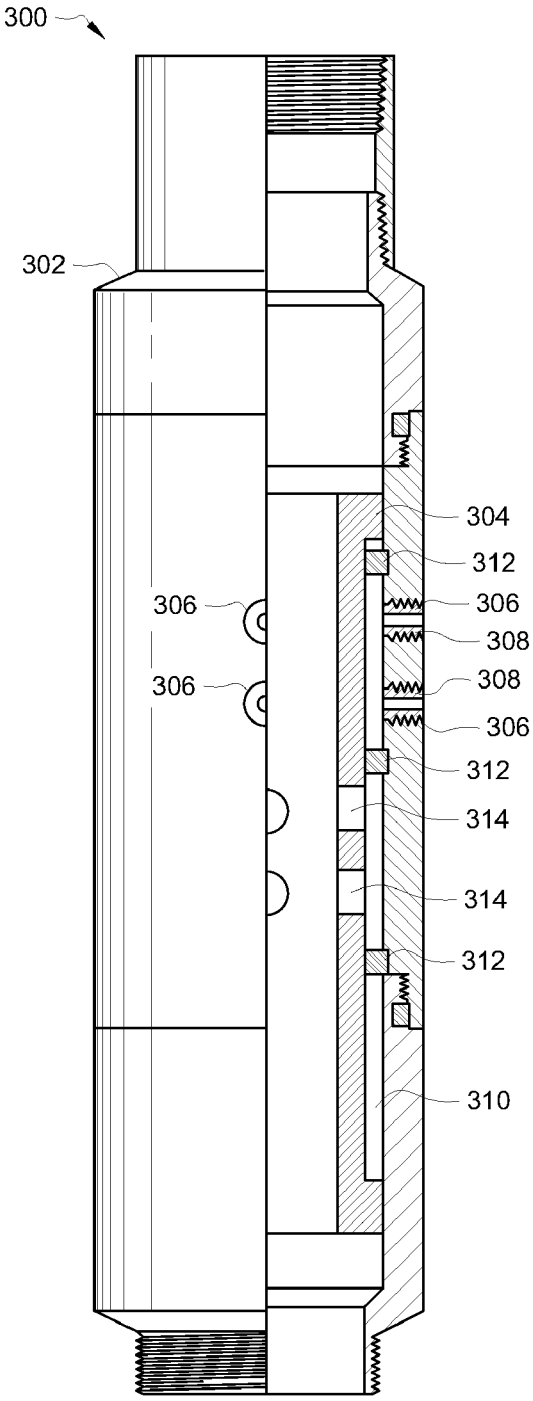
FIG. 4A is a partial cross-section view of a hydrojetting casing window assembly.
Figure 4B:
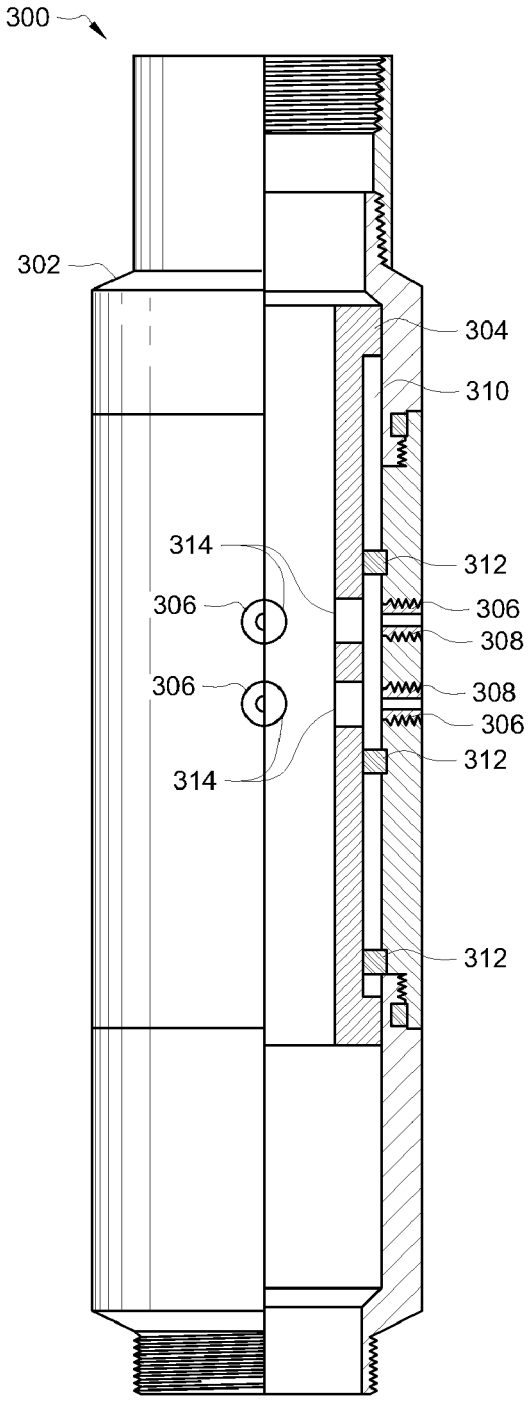
FIG. 4B is a partial cross-section view of the casing window assembly of FIG. 4A in a shifted position.

Referring now to FIGS. 4A and 4B, an exemplary casing window assembly 300 is shown as adapted for use in the well completion assembly 200. As used herein, the term "casing window" refers to a section of casing configured to enable selective access to one or more specified zones of an adjacent subterranean formation. A casing window has a window that may be selectively opened and closed by an operator, for example, movable sleeve member 304. The casing window assembly 300 can have numerous configurations and can employ a variety of mechanisms to selectively access one or more specified zones of an adjacent subterranean formation.

The casing window 300 includes a substantially cylindrical outer casing 302 that receives a movable sleeve member 304. The outer casing 302 includes one or more apertures 306 to allow the communication of a fluid from the interior of the outer casing 302 into an adjacent subterranean formation. The apertures 306 are configured such that fluid jet forming nozzles 308 may be coupled thereto. In some embodiments, the fluid jet forming nozzles 308 may be threadably inserted into the apertures 306. The fluid jet forming nozzles 308 may be isolated from the annulus 310 (formed between the outer casing 302 and the movable sleeve member 304) by coupling seals or pressure barriers 312 to the outer casing 302.

The movable sleeve member 304 includes one or more apertures 314 configured such that, as shown in FIG. 4A, the apertures 314 may be selectively misaligned with the apertures 306 so as to prevent the communication of a fluid from the interior of the movable sleeve member 304 into an adjacent subterranean formation. The movable sleeve member 304 may be shifted axially, rotatably, or by a combination thereof such that, as shown in FIG. 4B, the apertures 314 selectively align with the apertures 306 so as to allow the communication of a fluid from the interior of the movable sleeve member 304 into an adjacent subterranean formation. The movable sleeve member 304 may be shifted via the use of a shifting tool, a hydraulic activated mechanism, or a ball drop mechanism.

Figure 5:
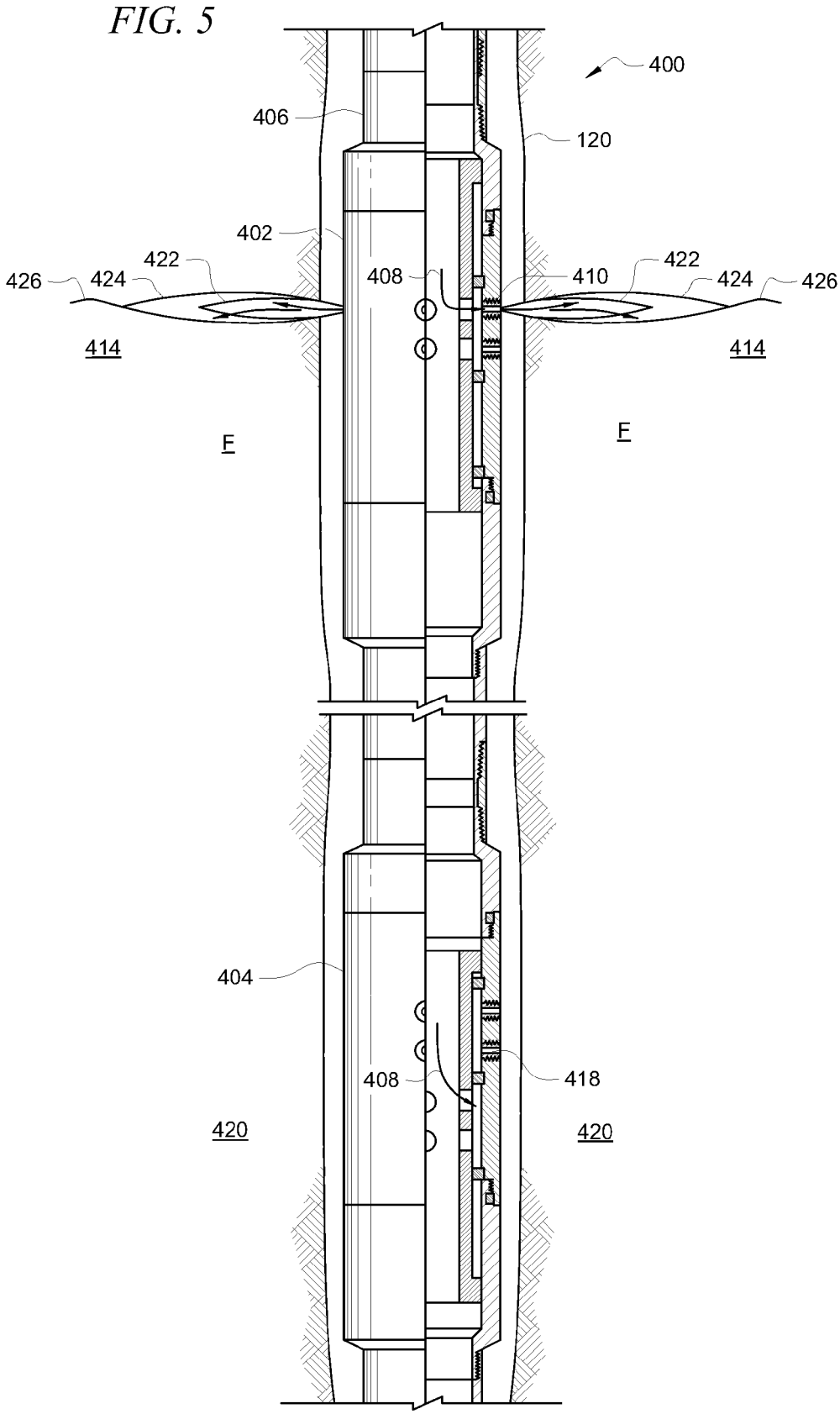
FIG. 5 is a partial cross-section view of a well completing assembly including embodiments of FIGS. 4A and 4B.

Referring now to FIG. 5, an exemplary well completion assembly 400 includes open casing window 402 and closed casing window 404 formed in a conduit 406. Alternatively, the well completion assembly 400 may be selectively configured such that the casing window 404 is open and the casing window 402 is closed, such that the casing windows 402 and 404 are both open, or such the that casing windows 402 and 404 are both closed.

A fluid 408 may be pumped down the conduit 406 and communicated through the fluid jet forming nozzles 410 of the open casing window 402 against the surface of the well bore 120 in the zone 414 of the subterranean formation F. The fluid 408 would not be communicated through the fluid jet forming nozzles 418 of the closed casing window 404, thereby isolating the zone 420 of the subterranean formation F from any well completion operations being conducted through the open casing window 402 involving the zone 414. The fluid 408 may include any of the embodiments disclosed elsewhere herein.

In one embodiment, the fluid 408 is pumped through the fluid jet forming nozzles 410 at a velocity sufficient for fluid jets 422 to form perforation tunnels 424. In one embodiment, after the perforation tunnels 424 are formed, the fluid 408 is pumped into the conduit 406 and through the fluid jet forming nozzles 410 at a pressure sufficient to form cracks or fractures 426 along the perforation tunnels 424.

The embodiments disclosed above including hydrojetting are especially useful in deviated or horizontal well bores. In deviated or horizontal well bores, fractures induced in the formation tend to extend longitudinally, or parallel, relative to the well bore. Such fractures limit production. Hydrojetting causes fractures to extend radially outward, transverse, or perpendicular relative to the well bore. Such transverse fractures increase the area of the fractured zone, thereby increasing production of hydrocarbons from the formation. Including more hydrojetting apertures along the tool also increases the length of the fractured zone.

The embodiments described above are illustrative of various fluid jetting tools and conveyances to which embodiments described below may be applied. Other conveyances for fluid jetting apertures or nozzles are contemplated by the present disclosure as indicated below and elsewhere herein.

Figure 6A:
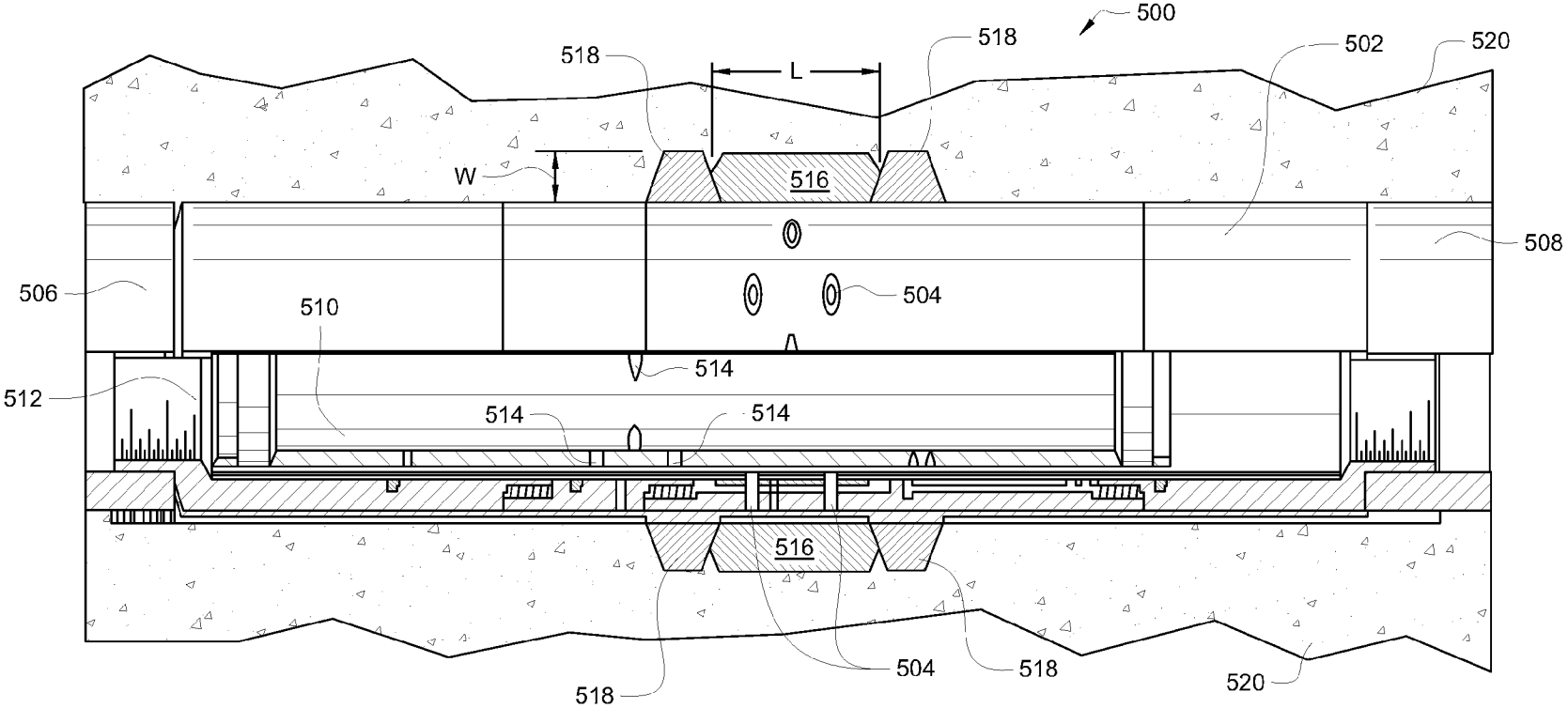
FIG. 6A is a partial cross-section view of an exemplary fluid jetting window assembly in an open position.

Referring now to FIG. 6A, a partial cross-section view of a fluid jetting window assembly 500 is shown, wherein the lower half of the assembly 500 is shown in cross-section for viewing certain internal components of the assembly 500. The fluid jetting window assembly 500 includes an outer housing 502 having a flow bore 512 and apertures 504, which will be described as jet forming apertures 504 but may also be pressurizing apertures or ports for directing fracturing fluids from the tool into the formation. The outer housing 502 may be coupled to casing string portions 506, 508 to form a casing string cementable within a well bore as previously shown and described herein. As noted previously, the well bore may be vertical, horizontal, or various angles in between, and thus it is to be understood that the horizontal depiction of assembly 500 in FIGS. 6A-E and 7 may apply to any such well bore orientation. The outer housing 502 retains a movable window sleeve 510, the window sleeve 510 being reciprocally disposed within the flowbore 512 of the outer housing 502. The window sleeve 510 includes apertures 514 for communicating with a fluid flowing through the flow bore 512. A removable member 516 is disposed over a portion of the outer surface of the outer housing 502 having the jet forming apertures 504.

In the embodiment shown in FIG. 6A, the removable member 516 is a sleeve disposed around the outer housing 502 and over the jet forming apertures 504. Retaining rings 518 are positioned above and below the removable sleeve 516 to couple the sleeve 516 to the outer housing 502 and retain the sleeve 516 in place over the jet forming apertures 504 (sleeve 516 and rings 518 being shown in cross-section). In some embodiments, the retaining rings 518 protect the removable sleeve 516 as the assembly 500 moves through the well bore 120. The removable sleeve 516 is configured to cover the jet forming apertures 504 and isolate them from materials, fluid, and other obstructions that may be applied to the exterior of the outer housing 502 in the well bore environment. For the sake of clarity, the embodiments of FIGS. 6A through 7 are described with the removable member 516 being a sleeve, and the jetting tool assembly 500 being a jetting window conveyed as part of a casing string. Further, the casing string and assembly 500 are cemented in the well bore with cement 520 as one example of a plugging material that may obstruct the fluid jet forming apertures. However, as is recognized throughout the present disclosure, other combinations of fluid pressurizing or jetting tools (e.g., tools such as those shown in FIGS. 1 to 5), removable members, and obstructions are contemplated as part of the present disclosure.

In some embodiments, the sleeve 516 is removable by degradation. The degradable sleeve 516 may comprise a variety of materials. For example, the degradable sleeve may comprise water-soluble materials such that the sleeve degrades as it absorbs water. In an embodiment, the degradable sleeve 516 comprises a biodegradable material such as polylactic acid (PLA). In some embodiments, the degradable sleeve 516 comprises metals that degrade when exposed to an acid, also known as "acidizing." Other embodiments for degradable sleeve 516 are also disclosed herein.

For example, the sleeve 516 comprises consumable materials that burn away and/or lose structural integrity when exposed to heat. Such consumable components may be formed of any consumable material that is suitable for service in a downhole environment and that provides adequate strength to enable proper operation of the degradable sleeve 516. In embodiments, the consumable materials comprise thermally degradable materials such as magnesium metal, a thermoplastic material, composite material, a phenolic material or combinations thereof.

In an embodiment, the degradable materials comprise a thermoplastic material. Herein a thermoplastic material is a material that is plastic or deformable, melts to a liquid when heated and freezes to a brittle, glassy state when cooled sufficiently. Thermoplastic materials are known to one of ordinary skill in the art and include for example and without limitation polyalphaolefins, polyaryletherketones, polybutenes, nylons or polyamides, polycarbonates, thermoplastic polyesters such as those comprising polybutylene terephthalate and polyethylene terephthalate; polyphenylene sulphide; polyvinyl chloride; styrenic copolymers such as acrylonitrile butadiene styrene, styrene acrylonitrile and acrylonitrile styrene acrylate; polypropylene; thermoplastic elastomers; aromatic polyamides; cellulosics; ethylene vinyl acetate; fluoroplastics; polyacetals; polyethylenes such as high-density polyethylene, low-density polyethylene and linear low-density polyethylene; polymethylpentene; polyphenylene oxide, polystyrene such as general purpose polystyrene and high impact polystyrene; or combinations thereof.

In an embodiment, the degradable materials comprise a phenolic resin. Herein a phenolic resin refers to a category of thermosetting resins obtained by the reaction of phenols with simple aldehydes such as for example formaldehyde. The component comprising a phenolic resin may have the ability to withstand high temperature, along with mechanical load with minimal deformation or creep thus provides the rigidity necessary to maintain structural integrity and dimensional stability even under downhole conditions. In some embodiments, the phenolic resin is a single stage resin. Such phenolic resins are produced using an alkaline catalyst under reaction conditions having an excess of aldehyde to phenol and are commonly referred to as resoles. In some embodiments, the phenolic resin is a two stage resin. Such phenolic resins are produced using an acid catalyst under reaction conditions having a substochiometric amount of aldehyde to phenol and are commonly referred to as novalacs. Examples of phenolic resins suitable for use in this disclosure include without limitation MILEX and DUREZ 23570 black phenolic which are phenolic resins commercially available from Mitsui Company and Durez Corporation respectively.

In an embodiment, the degradable material comprises a composite material. Herein a composite material refers to engineered materials made from two or more constituent materials with significantly different physical or chemical properties and which remain separate and distinct within the finished structure. Composite materials are well known to one of ordinary skill in the art and may include for example and without limitation a reinforcement material such as fiberglass, quartz, kevlar, Dyneema or carbon fiber combined with a matrix resin such as polyester, vinyl ester, epoxy, polyimides, polyamides, thermoplastics, phenolics, or combinations thereof. In an embodiment, the composite is a fiber reinforced polymer.

The degradable sleeve 516 is used for description purposes herein, but the removable member is not to be limited by same. In some embodiments, the removable member is removable by other means. For example, in some embodiments, the removable member is a sleeve movable by actuation or shifting, as with the movable sleeve member 304. In other embodiments, the removable member may be removed by breakage.

Referring now to FIGS. 6A through 6E, the fluid jetting window assembly 500 is illustrated in operation, wherein the embodiment shown includes a degradable sleeve 516. Referring first to FIG. 6A, a closed position of the fluid jetting window assembly 500 is shown, wherein the window sleeve 510 is positioned such that the apertures 514 communicating with the fluid in the flowbore 512 are misaligned with the jet forming apertures 504. The degradable sleeve 516 is disposed about the outer housing 502 adjacent the jet forming apertures 504, and retained by retaining rings 518. The window assembly 500, in this "run-in" position, may be coupled to casing string portions 506, 508 and conveyed together into a well bore, such as well bore 120. Cement 520 may then be applied to the outer portions of the window assembly 500 and casing string portions 506, 508 to attach them to the well bore (not shown). The sleeve 516 prevents cement from entering the jet forming apertures 504 and plugging them or otherwise obstructing the apertures.

In some embodiments of the cemented, closed position shown in FIG. 6A, the degradable sleeve 516 begins to degrade immediately or soon after the assembly 500 is cemented into position. For example, if the degradable sleeve 516 is a PLA sleeve, water from the environment exterior of the housing 502 will contact the PLA sleeve and begin to degrade it. Water may come from screens in the back side of the casing, for example, or from the cement slurry. The degradable sleeve 516 may experience varying degrees of degradation, from little to entire sleeve consumption, for example, while the assembly 500 is closed. Alternatively, the sleeve 516 may have begun to degrade from exposure to other fluids or materials present in the well bore during other operations involving the jetting window assembly 500.

Figure 6B:
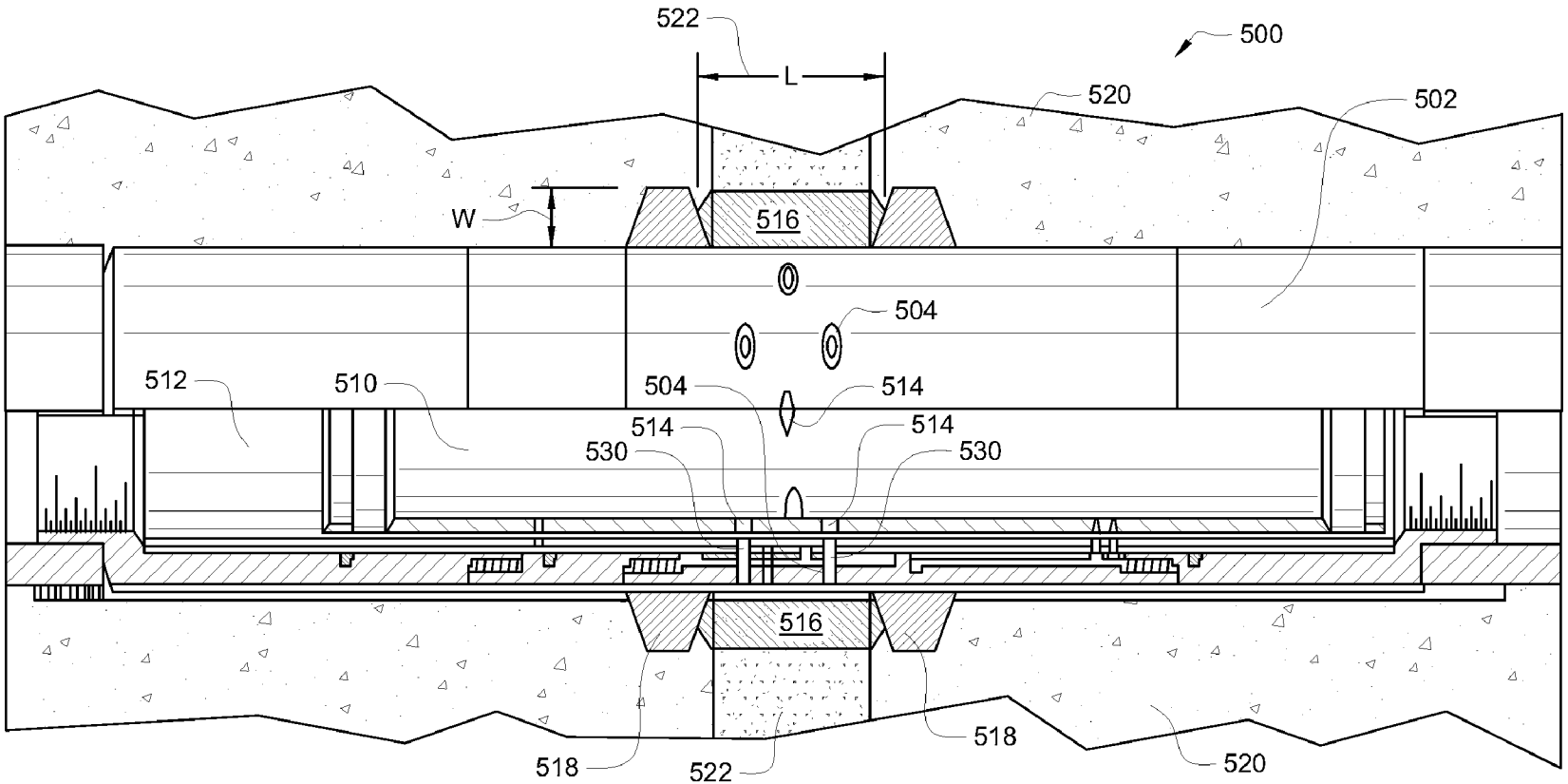
FIG. 6B is a partial cross-section view of an embodiment of the assembly of FIG. 6A in a closed position.
Figure 7:
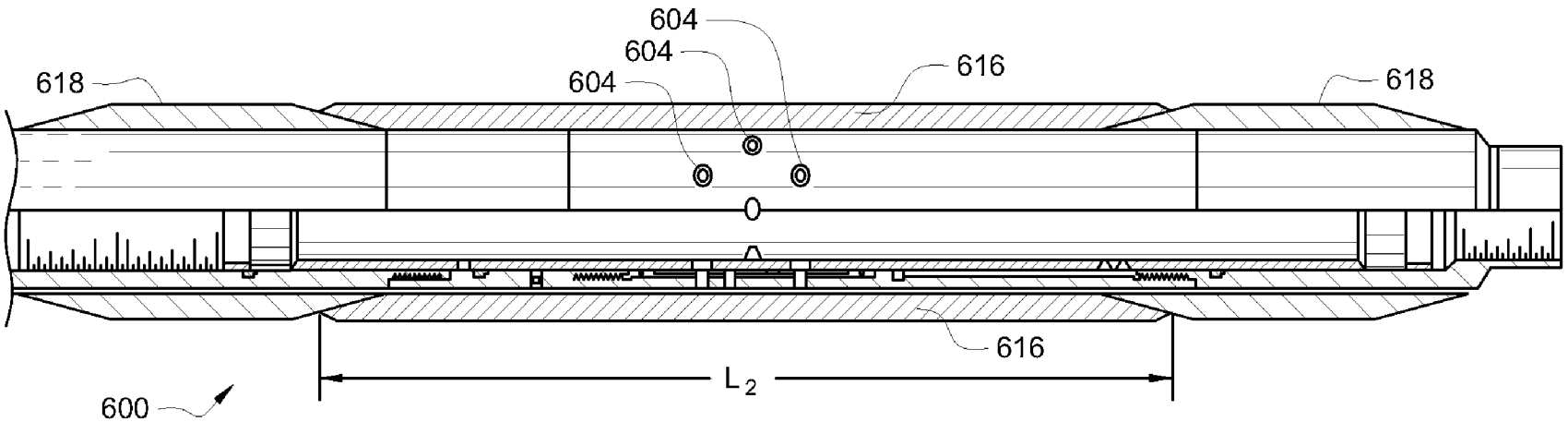
FIG. 7 is a partial cross-section view of an alternative embodiment of the fluid jetting window assembly of FIG. 6A.

Referring now to FIG. 6B, fluid jetting window assembly 500 is shown in the open position. The window sleeve 510 has been selectively actuated, mechanically, hydraulically, or by other means for actuating movable sleeves, to a position where the window apertures 514 are aligned with the jet forming apertures 504. The alignment of the window apertures 514 and the jet forming apertures 504 provides a fluid jet flow path 530 between the interior flow bore 512 and the exterior of the outer housing 502. At this time, in embodiments including a biodegradable sleeve 516, the sleeve 516 is in varying stages of degradation. In alternative embodiments, the sleeve 516 is moved, broken, or otherwise removed from covering the jet forming apertures 504 just before or after the assembly is opened as just described. It may be desirable to degrade or remove the sleeve 516 before the assembly 500 is opened such that the apertures 504 are uncovered, or partially uncovered, while pressure integrity is maintained within the assembly 500.

In some embodiments wherein a degradable sleeve is present, while the assembly 500 is in the open position, a fluid is communicated from the flow bore 512, through the jet flow path 530, and to the degradable sleeve 516 to begin or assist in the degradation process. In embodiments where the sleeve is made of PLA or other biodegradable materials, it may take, for example, a day to several days for substantial degradation of the sleeve to occur while only exposed to the well bore environment. In one embodiment, an acid may be "spotted" through the jet flow path 530 to assist with degradation of the sleeve 516. This provides a more selective degradation of the degradable sleeve 516. Spotting acid at this point and location may also focus the process of extending the jet flow path from the jet forming apertures 504 radially outward from the housing 502 at least to a distance equal to the width W of the sleeve 516. In a further embodiment wherein the sleeve 516 is made of metal, such as aluminum, or another more robust material, an acid may be flowed into the jet flow path 530 to melt or otherwise degrade the sleeve while the assembly 500 is in the open position.

In additional embodiments wherein the sleeve 516 is degradable, the degradation of the sleeve 516 may create an acid, such as lactic acid, or other erosive material which then begins to degrade the cement. Degradation of the cement beyond the sleeve 516 assists in further extending the jet flow path generally in the area 522 of the cement formation 520 (which is created from a cement slurry applied in the usual manner).

In still further embodiments, the jet forming apertures 504 may be filled with a degradable substance or removable member. In one embodiment, the apertures 504 are filled with a plug made of the same material as the degradable sleeve 516, such as PLA. A PLA plug may simply be a portion of PLA in the shape of a plug that is adapted to be inserted into an aperture 504. In another embodiment, the apertures 504 are filled with a gel that can be degraded as disclosed herein, or may be pushed out of the apertures 504 with fluid pressure. It yet another embodiment, the apertures 504 can be filled with removable members, for example, rupture disks that are selectively ruptured for removal. In the embodiments just described, the aperture-fillers may be used in conjunction with the sleeve 516, or, alternatively, in place of the sleeve. If the sleeve 516 is not present, the aperture-fillers just described may be removed consistent with those embodiments disclosed herein. In such an embodiment, certain benefits may be achieved, such as the presence of less PLA material; however, certain features are compromised, such as the cavity created by a sleeve beyond the outer tool surface to increase jetting, and the increased acidization provided by a sleeve.

Figure 6C:
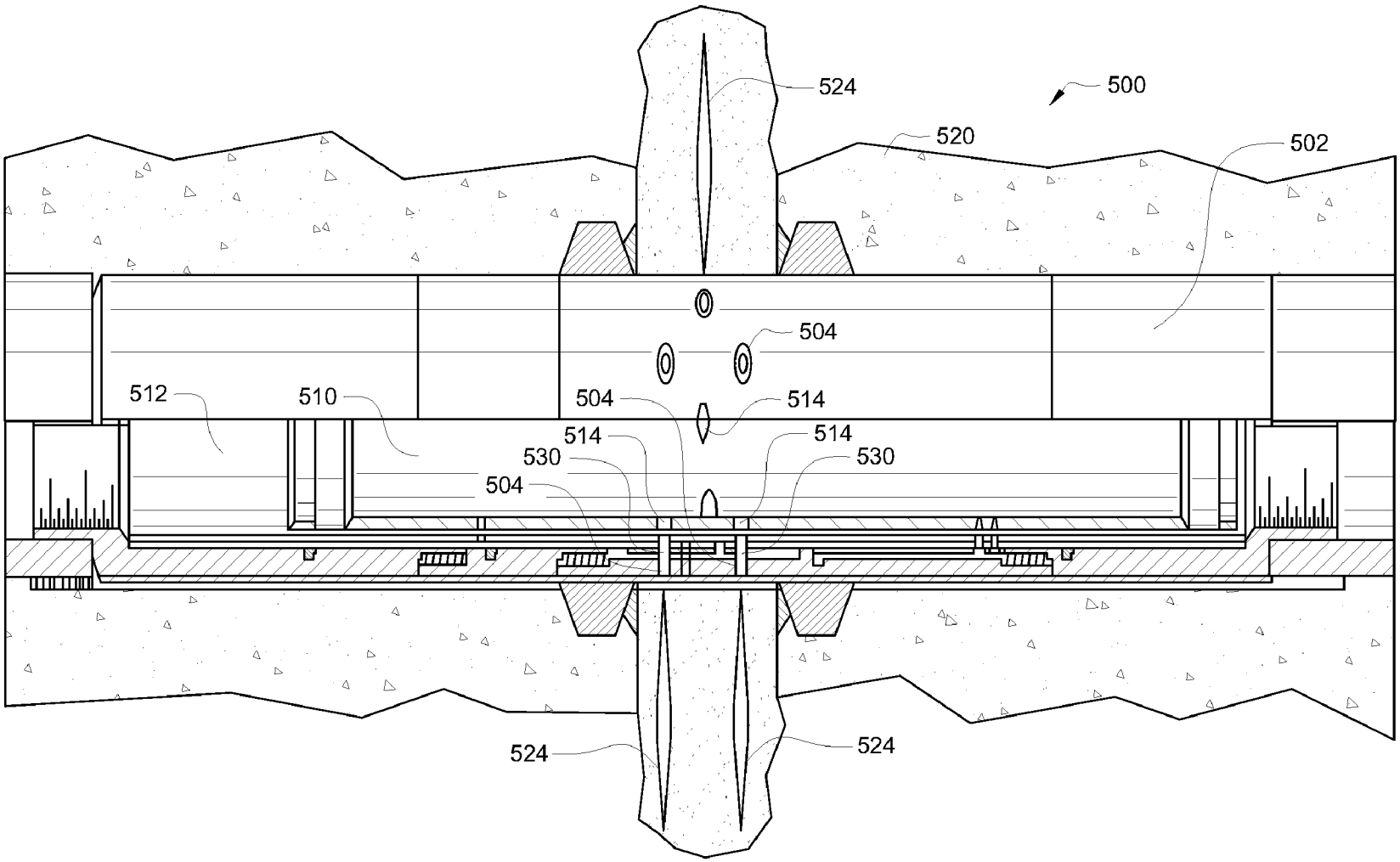
FIG. 6C is a partial cross-section view of an embodiment of the assembly of FIG. 6B showing removal of a removable member.

Referring now to FIG. 6C, degradation of the sleeve 516 has weakened the sleeve 516 and, in some embodiments, the adjacent cement or other surrounding degradable materials. A fluid, such as a perforating or fracturing fluid, is pumped through the flow bore 512 and into the first jet flow path 530 formed by the aligned window apertures 504 and jet forming apertures 504. The fluid jet from the jet forming apertures 504 creates a perforation 524, or second jet flow path, extending from the jet forming apertures 504, through the degraded sleeve 516 (or possibly a completely eliminated sleeve depending on the degree of degradation), and into the cement formation 520.

Despite the high pressure in flow bore 512, the perforation 524 or other extension of the jet fluid flow path beyond the jet forming apertures 504 is significantly hindered without the sleeve 516. As used herein, high pressure, for example, is generally greater than about 3,500 p.s.i., alternatively greater than about 10,000 p.s.i., and alternatively greater than about 15,000 p.s.i. If sleeve 516 is not present, the cement 520 abuts the outer housing 502 and is flush with the jet forming apertures 504, thereby obstructing them and resisting fluid flow. Cement may also enter the jet forming apertures 504 and plug them, thereby further increasing resistance to fluid flow therethrough. Under these circumstances, the area of the cement, or other viscous material applied to the outer housing 502, to which the high pressure fluid in the flow bore 512 is applied is very small, i.e., the size of the jet forming aperture, which is intended to be small to provide the fluid jetting function. If, for example, the jet forming aperture has a diameter of 0.25 inches, the area of the aperture is 0.049 inches squared. Even at 5,000 p.s.i. in flow bore 512, the force applied to the cement 520 is approximately 250 pounds. A force of this size is typically not efficient to crack or perforate the cement 520.

Removal of the sleeve 516, however, increases the force applied to the cement 520 by creating distance between the jet forming apertures 504 and the cement 520 and widening the area upon which the high pressure jet is applied. For example, as shown in FIGS. 6A and 6B, the area of applied pressure may be increased, in one dimension, from the diameter of the aperture 504 to the length L of the sleeve 516. Furthermore, the distance between the apertures 504 and the cement 520 also allows the high pressure fluid to flow along an extended fluid jet flow path. For example, as also shown in FIGS. 6A and 6B, the distance W may be used to extend the high pressure fluid jet flow path.

Figure 6D:
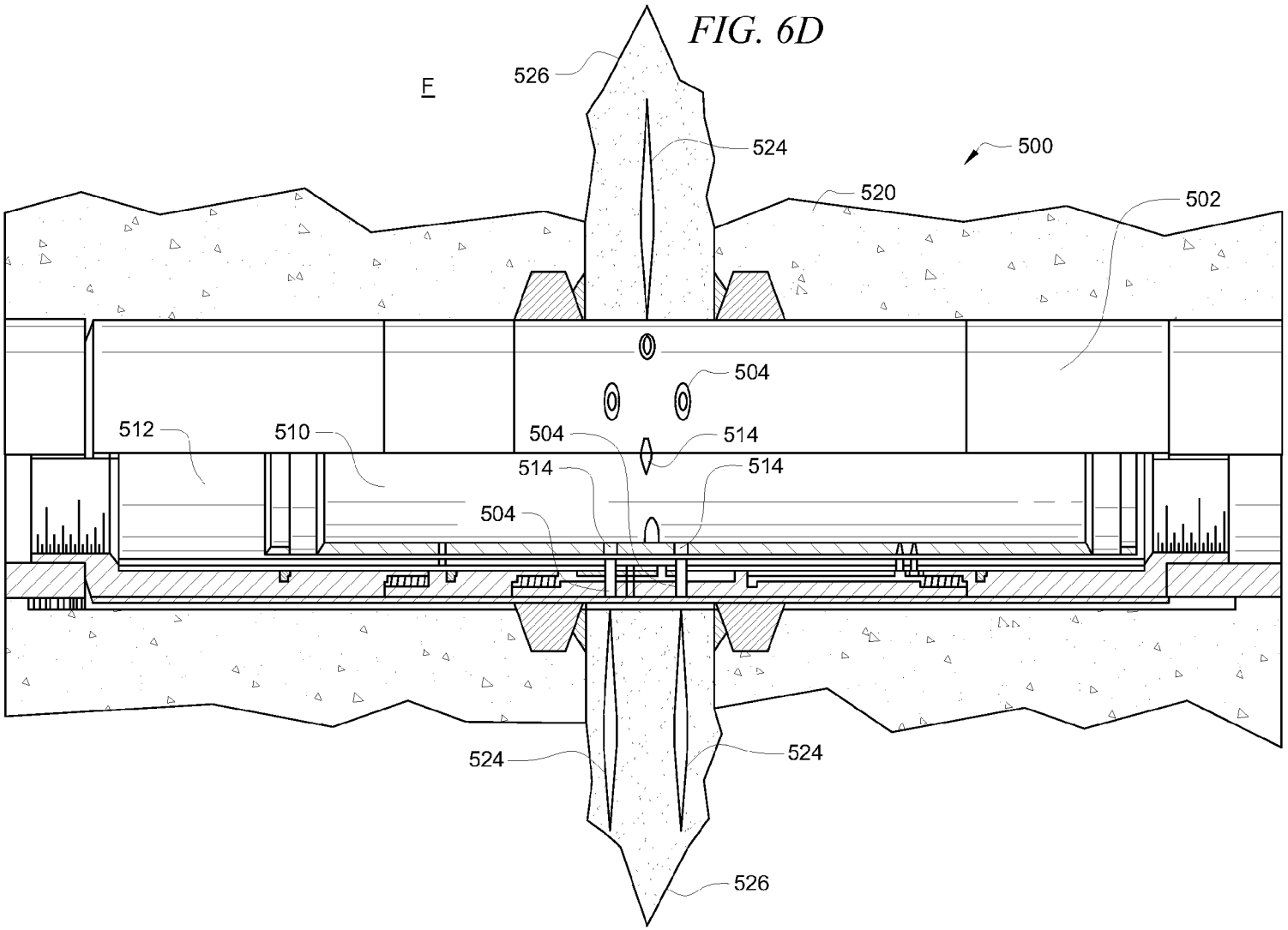
FIG. 6D is a partial cross-section view of an embodiment of the assembly of FIG. 6C showing fracturing.
Figure 6E:
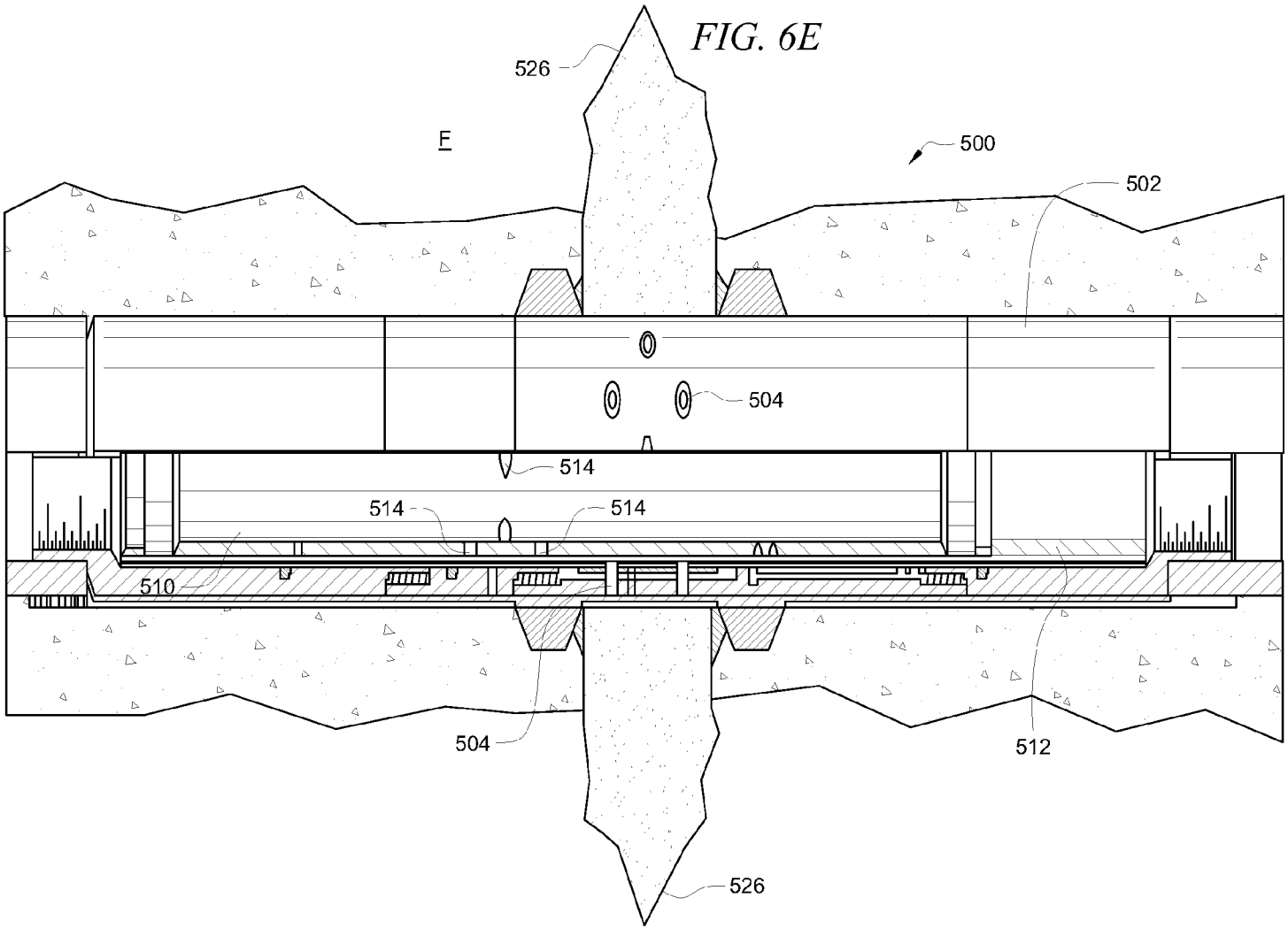
FIG. 6E is a partial cross-section view of an embodiment of the assembly of FIG. 6D moved to a closed position.

Referring next to FIG. 6D, the fluid in flow bore 512 continues to be pumped at a high pressure such that the fluid continues to flow along the first jet fluid flow path 530 at apertures 514, 504, along the second jet fluid flow path extending from the jet forming apertures 504 and along the perforations 524, and further extends the jet fluid flow path at the fractures 526. The fractures 526 increase production of hydrocarbons from the formation F. In one embodiment, hydrocarbons may be produced through the assembly 500 by pumping fluids in the flow bore 512 in the opposite direction, thereby drawing hydrocarbons from the formation F along the jet fluid flow path at the fracture 526, the perforations 524, and finally in through the aligned apertures 514, 504. In another embodiment, as shown in FIG. 6E, the jetting window assembly 500 may be closed. The window sleeve 510 is moved or actuated back to its original closed position, thereby misaligning the apertures 514 and the jet forming apertures 504 and preventing fluid flow therebetween.

Referring to FIG. 7, an alternative embodiment of the jetting window assembly is shown. Jetting window assembly 600 includes a larger degradable sleeve 616 (which may also be any of the various sleeves or removable members disclosed herein) bounded by larger retaining and protection rings 618. In this embodiment, the area of isolation about the jet forming apertures 604 is increased, as partially shown by the dimensional length $L_2$. As previously disclosed, increasing the length to $L_2$ increases the available area for fluid jetting onto the cement formation (not shown), and thereby increasing the perforating and fracturing forces on the cement. Furthermore, the length $L_2$, as opposed to the length L of FIGS. 6A and 6B, for example, provides more flow space for creating longitudinal fractures. A sleeve with length L may be used for creating transverse fractures.

The various embodiment described herein provide a system for isolating apertures in a high pressure fluid stimulation tool from the exterior of the tool and preventing the apertures from becoming plugged or otherwise obstructed. In some embodiments, the apertures include jet forming nozzles that are susceptible to plugging when the tool in which the jet forming nozzles are placed is cemented onto a well bore. In addition to cementing, other downhole operations or conditions may also introduce plugging materials or hindrances at the nozzles in a jetting tool. A plugged or hindered jetting nozzle then cannot perform its fluid jetting function properly. Thus, maintaining unplugged and unobstructed high pressure fluid apertures and/or jet forming nozzles in high precision fluid stimulation tools is very beneficial. In addition, while some embodiments disclosed herein include acidizing a degradable sleeve, the embodiments of the system disclosed herein avoid the difficult and expensive step of attempting to acidize cement or other obstruction present inside the relatively small fluid apertures and/or jet forming nozzles.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method of servicing a well bore penetrating a subterranean formation comprising:

applying a removable, member to an exterior of a well bore servicing tool, wherein the removable member covers at least one high pressure fluid aperture disposed in the tool;

lowering the tool into the well bore;

exposing the tool to a well bore material, wherein the removable cover prevents the well bore material from entering the high pressure fluid aperture;

removing the removable member to expose a fluid flow path adjacent to the high pressure fluid aperture, wherein removing the removable member comprises degrading a protective sleeve; and flowing a well bore servicing fluid through the fluid aperture outlet and flow path.

2. The method of claim 1 wherein degrading the protective sleeve comprises contacting the removable member with an acid.

3. The method of claim 1 wherein flowing the well bore servicing fluid further expands the fluid flow path adjacent the tool, into the subterranean formation, or both.

4. A method of servicing a well bore penetrating a subterranean formation comprising:

applying a removable member to an exterior of a well bore servicing tool, wherein the removable member covers at least one high pressure fluid aperture disposed in the tool;

lowering the tool into the well bore;

exposing the tool to a well bore material, wherein the removable cover prevents the well bore material from entering the high pressure fluid aperture;

removing the removable member to expose a fluid flow path adjacent to the high pressure fluid aperture, wherein removing the removable member comprises breaking the removable member; and flowing a well bore servicing fluid through the fluid aperture outlet and flow path.

5. A method of servicing a well bore penetrating a subterranean formation comprising:

disposing a fluid jetting tool in the well bore, the fluid jetting tool having a fluid jetting aperture and a removable member adjacent the fluid jetting aperture;

cementing the fluid jetting tool into the well bore, wherein the removable member prevents cement from entering the fluid jetting aperture; and removing the removable member to expose a fluid flow path adjacent to the fluid jetting aperture.

6. The method of claim 5 further comprising:

pumping a well bore servicing fluid into the fluid jetting tool and through the fluid jetting aperture; and perforating the cement to further expand the fluid flow path.

7. The method of claim 6 further comprising:

continuing to pump the servicing fluid into the subterranean formation adjacent the perforated cement to fracture the subterranean formation.

8. The method of claim 5 wherein removing the removable member comprises hydrating a biodegradable sleeve.

9. The method of claim 5 wherein removing the removable member comprises degrading a degradable sleeve.

10. The method of claim 5 wherein removing the removable member comprises exposing a consumable sleeve to heat.

11. The method of claim 5 wherein removing the removable member comprises acidizing a degradable sleeve.

12. The method of claim 5 further comprising removing a plug from the fluid jetting aperture.

13. The method of claim 5 further comprising:

actuating a casing window in the fluid jetting tool to expose the fluid jetting aperture to the well bore servicing fluid; and flowing the servicing fluid through the casing window and the fluid jetting aperture.

14. A method of servicing a well bore penetrating a subterranean formation comprising:

disposing a fluid jetting tool in the well bore, the fluid jetting tool having a fluid jetting aperture and a removable member adjacent the fluid jetting aperture;

removing the removable member to expose a fluid flow path adjacent to the fluid jetting aperture; and pumping a well bore servicing fluid into the fluid jetting tool and through the fluid jetting aperture.

15. The method of claim 14 further comprising:

continuing to pump the servicing fluid into the subterranean formation adjacent the fluid jetting aperture to fracture the subterranean formation.

16. The method of claim 14 wherein removing the removable member comprises hydrating a biodegradable sleeve.

17. The method of claim 14 wherein removing the removable member comprises degrading a degradable sleeve.

18. The method of claim 14 wherein removing the removable member comprises exposing a consumable sleeve to heat.

19. The method of claim 14 wherein removing the removable member comprises acidizing a degradable sleeve.

20. The Method of claim 14 further comprising removing a plug from the fluid jetting aperture.

21. The method of claim 14 further comprising:

prior to pumping a well bore servicing fluid into the fluid jetting tool, actuating a movable sleeve disposed in the fluid jetting tool to expose the fluid jetting aperture to the well bore servicing fluid.

* * * * *